United States Patent [19]

Tipton

[11] 4,034,029

[45] July 5, 1977

[54] METERING ROD CONTROL FOR AN AIR VALVE CARBURETOR

[75] Inventor: Larry J. Tipton, Florissant, Mo.

[73] Assignee: ACF Industries, Incorporated, St. Louis, Mo.

[22] Filed: July 19, 1976

[21] Appl. No.: 706,511

[52] U.S. Cl. ..... 261/44 R; 138/45; 251/205; 251/321; 251/DIG. 4; 261/DIG. 38

[51] Int. Cl.[2] ..... F02M 9/06

[58] Field of Search ..... 261/DIG. 38, 44 R; 138/45, 46; 251/321, 205, DIG. 4

[56] References Cited

UNITED STATES PATENTS

| | | | |
|---|---|---|---|
| 1,961,747 | 6/1934 | Ewart | 138/46 |
| 2,569,147 | 9/1951 | Boller | 138/45 |
| 2,591,090 | 4/1952 | Newman | 138/46 |
| 3,222,039 | 12/1965 | Newman et al. | 138/45 |
| 3,653,642 | 4/1972 | Lawrence | 261/44 R |
| 3,956,434 | 5/1976 | Dickensheets et al. | 261/44 R |

FOREIGN PATENTS OR APPLICATIONS

| | | | |
|---|---|---|---|
| 1,144,405 | 3/1969 | United Kingdom | 261/50 A |

*Primary Examiner*—Tim R. Miles

[57] ABSTRACT

An air valve for a carburetor has its lower end mounted for pivotal movement between open and closed positions relative to the air and fuel mixture conduit and carries a metering rod which extends generally in a horizontal direction. The metering rod has an end extending within a metering orifice of an orifice plate in an opening of the mixture conduit wall. The metering rod is urged by a coiled torsion spring upwardly against the orifice plate. The torsion spring has a small coil with a relatively high spring rate and a large coil with a relatively low spring rate. The large coil continuously urges the rod into engagement with the upper surface of the orifice plate defining the orifice, while the small coil urges the rod into engagement with the orifice plate only after the air valve is around one half open. The metering rod is mounted for limited pivotal movement relative to the air valve and the torsion spring exerts a generally uniform light force to the metering rod throughout the longitudinal movement of the metering rod to compensate for the varying distance between the orifice plate and pivotal mounting of the metering rod and the increased load against the rod caused by impinging air flow.

7 Claims, 6 Drawing Figures

FUEL TANK
P

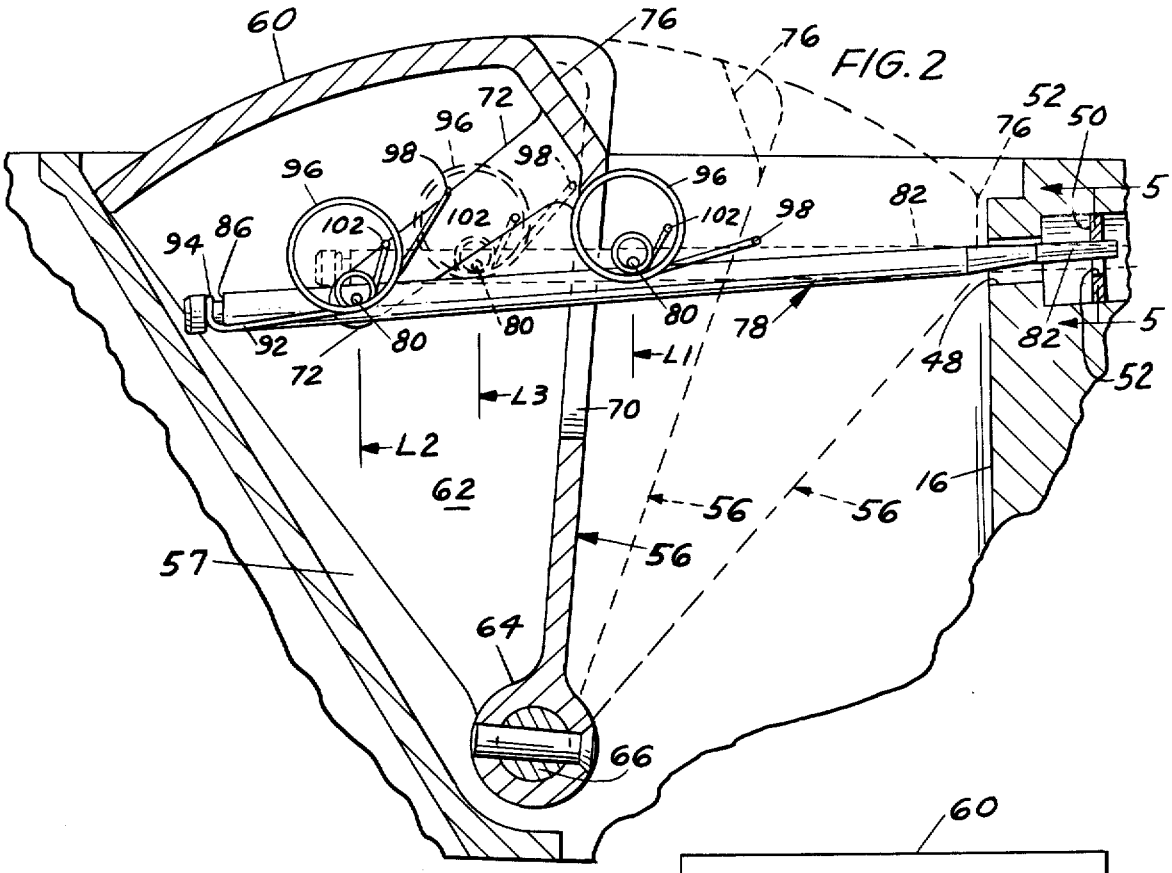
FIG. 2
FIG. 3
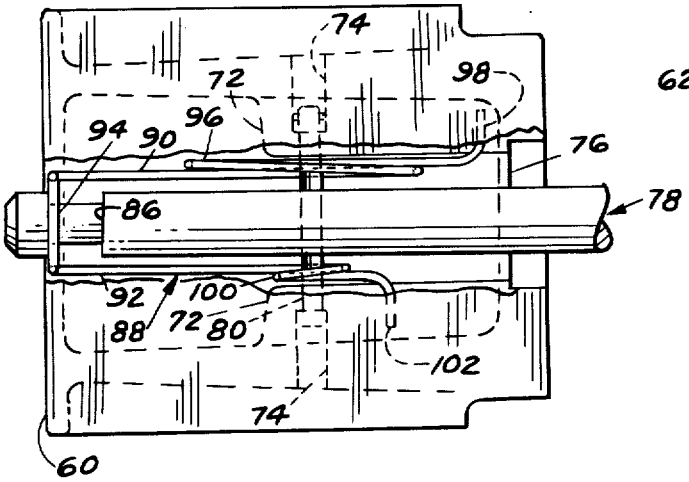
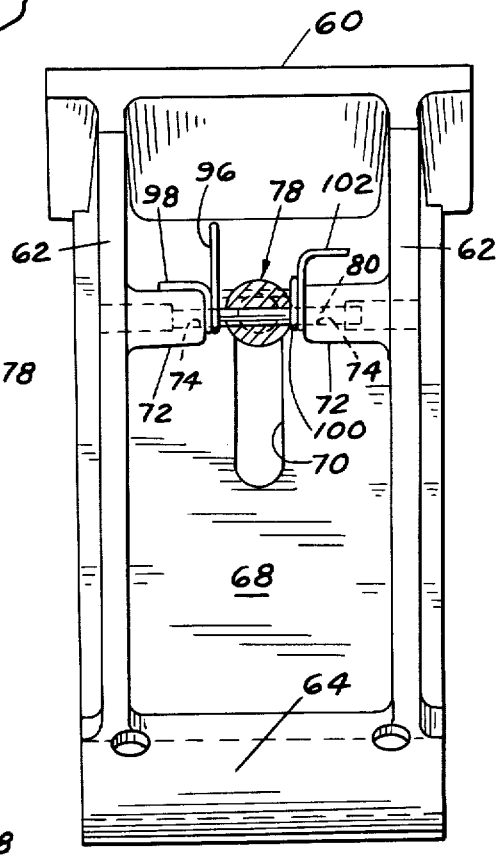
FIG. 4
FIG. 6
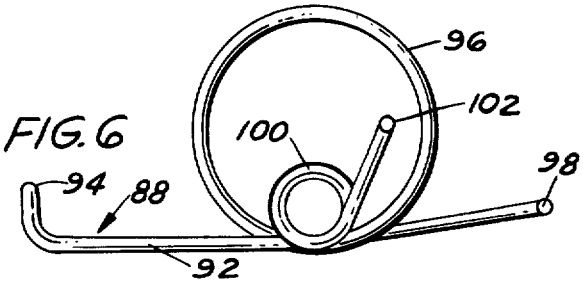

METERING ROD CONTROL FOR AN AIR VALVE CARBURETOR

BACKGROUND OF THE INVENTION

Heretofore, metering rods for carburetors have been provided with coil torsion springs to urge the metering rods into engagement with a side of a metering orifice. As metering rods have moved generally a limited vertical direction the torsion spring has provided a generally uniform force to the metering rod for the short travel of the metering rod. An example of a type of coil torsion spring employed for this purpose is illustrated in U.S. Pat. No. 1,961,747 dated June 5, 1934, in which a vertically movable metering rod has a torsion spring applying a constant force to the metering rod regardless of the position of the metering rod.

It is desirable to maintain a metering rod in contact with the surface defining the orifice in order to maintain a generally uniform fuel flow for a specific orifice cross section. As a practical matter, it is very difficult to hold a rod in the center of the orifice and if this could be accomplished, the flow would remain constant, but there is no practical or convenient means of doing this. Heretofore, such as shown in U.S. Pat. No. 1,961,747, coil springs have been provided to continuously urge a metering rod into engagement with a side of an orifice, With metering rods that move vertically, a generally uniform force has been applied to the metering rod during its entire movement by such torsion spring and the force urging the metering rod into engagement with the side of the orifice plate could be easily predetermined and maintained.

DESCRIPTION OF PRESENT INVENTION

With an air valve carburetor in which a variable venturi valve is mounted across the air and fuel mixture conduit and has its lower end pivotally mounted so that the venturi air valve may pivot between a closed position extending across the air and fuel mixture conduit and an open position in which it is removed from the air and fuel mixture conduit, the metering rod is positioned on and carried by the air valve. The elongated metering rod extends in a generally horizontal direction and is mounted for limited pivotal movement about a horizontal axis on the air valve, and has an extending end fitting within an orifice of a thin orifice plate in an opening of the conduit wall. It is highly desirable to have the metering rod held into contact with the upper side of the orifice as fuel adheres to the metering rod and it is desirable particularly with downward air flow to have the major portion of the fuel about the bottom and adjacent surfaces of the metering rod. It is highly desirable that the metering orifice maintain its original size so that a constant flow of fuel through the orifice is provided for a given suction at a given position of the metering rod.

Orifice plates are normally formed of a thin stainless steel material such as around 0.010 or 0.015 inch in thickness, for example. The constant frictional movement of a metering rod against a thin orifice plate results in wear if substantial friction is provided between the metering rod and the orifice plate. Therefore, it is desirable that a constant and uniform light force be applied to the metering rod to hold the metering rod in contact with the orifice, but with a force that does not create wear of the orifice plate to change the size of the orifice.

In an air valve carburetor, the metering rod is pivotally mounted on the air valve and pivots relative to the air valve upon movement of the air valve from its closed position to open position. Therefore, it is desirable that means be provided to apply a spring force to the metering rod that increases while the distance between the pivotal mounting of the metering rod and the orifice plate increases. The present invention has a torsion spring with a small coil of a relatively high spring rate and a large coil of a relatively low spring rate. The large coil initially engages the metering rod to urge the metering rod upwardly against the side of the orifice and increases in force gradually as the venturi valve moves to an open position. The distance between the pivotal mounting of the metering rod and the orific plate increases in length as the air valve moves to an open position and thus it is desirable that the force exerted against the metering rod increase gradually to compensate for the increased distance from the pivotal mounting of the metering rod to the orifice plate. After the air valve is around one half open the small diameter coil is engaged by the metering rod to increase the force exerting against the metering rod and further compensate for the increased distance from the orifice plate as the metering rod is pulled away from the orifice plate. It is also noted that the air flow moving downwardly in the air and fuel conduit of the carburetor tends to urge the metering rod downwardly against the bias of the torison spring and the torsion spring also compensates for this downward force.

The present invention permits, the application of a generally constant force by the metering rod against the thin metering orifice plate thereby to minimize any wear of the orifice plate by the frictional movement of the metering rod as it moves in and out with the venturi valve. A relatively light force is applied by the metering rod against the orifice plate and the metering orifice thereby retains its sized condition.

An air valve carburetor having an air valve therein carrying a metering rod having the torsion spring of the present invention thereon is illustrated in the accompanying drawings, forming a part of this application, in which:

FIG. 2 is an enlarged sectional view, partially schematic, showing the air valve and the metering rod thereon with the air valve shown in a fully open position;

FIG. 3 is a top plan of the air valve shown in FIG. 2 with the metering rod and torsion spring mounted thereon;

FIG. 4 is a rear elevation of the air valve with the metering rod and torsion spring mounted thereon;

FIG. 6 is an elevational view of the torsion spring removed from the air valve.

Figures 1, 5:
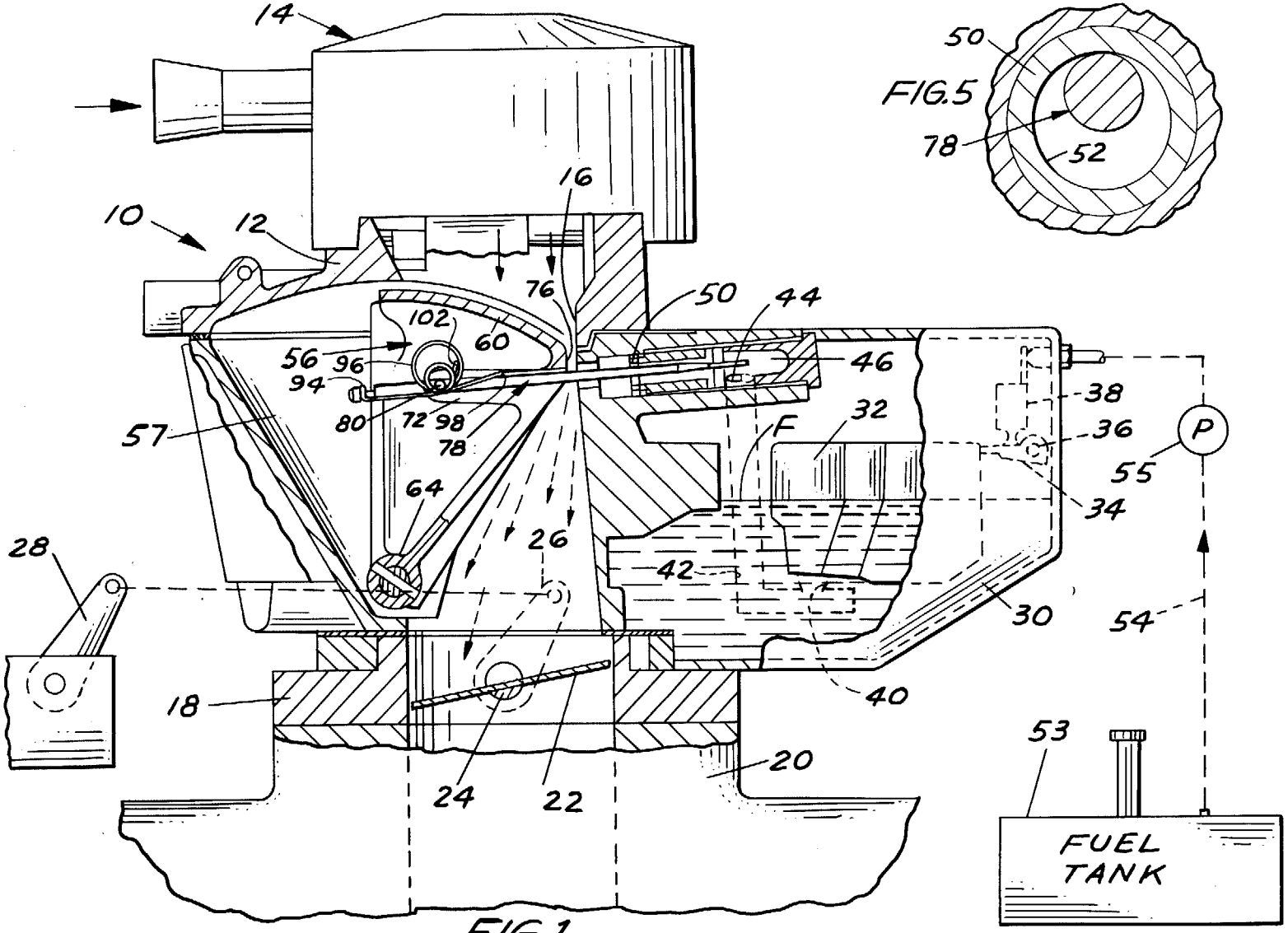
FIG. 1 is a sectional view, partially schematic, of an air valve carburetor illustrating a variable venturi valve carrying a metering rod with the torsion spring comprising the present invention thereon urging the metering rod into engagement with a thin orifice plate, the venturi valve being shown in a substantially closed position.
FIG. 5 is an enlarged section taken generally along line 5—5 of FIG. 2 and showing the metering rod in engagement with the upper side of the metering orifice in the orifice plate.

Referring to the drawings, and more particularly to FIG. 1, the air valve carburetor is generally indicated 10 having a body 12 with an air filter generally indicated 14 mounted on the air horn. An air and fuel mixture conduit 16 extends through body 12. The lower portion of body 12 has a flange 18 which may be attached to an intake manifold of an internal combustion engine shown generally at 20. A throttle valve 22 is mounted across mixture conduit 16 on throttle shaft 24. Shaft 24 has a link 26 secured thereto and a suitable linkage indicated schematically at 28 may be connected to a suitable foot pedal for operation.

Mounted adjacent body 12 is a fuel bowl shown generally at 30 and having a float 32 therein mounted about a float lever 34 pivoted at 36. A control needle valve 38 in contact with float lever 34 controls the flow of fuel to fuel bowl 30 as is well known in the art. In the bottom of fuel bowl 30 is a fuel opening 40 for main fuel passage 42. Fuel passage 42 has a port 44 communicating with a fuel chamber 46 for main fuel passage 42. Fuel is discharged from chamber 46 through a discharge part 48 in the wall of mixture conduit 16. Mounted in fuel chamber 46 is a thin orifice plate indicated at 50. Orifice plate 50 has an orifice 52 therein. Orifice plate 50 is preferably formed of a stainless steel material and has a thickness around 0.010 inch to 0.015 inch, for example. Fuel is supplied to fuel bowl 30 from the fuel tank indicated generally at 53 through a supply line 54 having a suitable fuel pump 55 therein as is well known. Fuel pump 55 is indicated by the letter "P" and the fuel level in fuel bowl 30 is indicated by the letter "F".

Mounted above throttle valve 22 across air and fuel mixture conduit 16 is an air valve structure comprising a variable venturi valve generally indicated at 56. Body 12 has a pocket or large recess 57 therein adjacent and communicating with air and fuel conduit 16 and is adapted to receive venturi valve 56 upon movement of venturi valve 56 to the fully open position as shown particularly in FIG. 2. Venturi valve 56 has an upper curved segment 60 which extends between and is integral with spaced sides 62. Upper curved segment 60 extends across mixture conduit 16 in the closed position of valve 56. A lower hub 64 extends between the lower end of sides 62 and a shaft 66 journalled in body 12 mounts valve 56 for pivotal movement between the closed position shown in FIG. 1 and the open position shown in FIG. 2. A web 68 extends between sides 62 and has a downwardly extending slot 70 therein. An inwardly extending lug or extension 72 is secured to each side 62 and each lug 72 has an axial opening 74 therein extending through the associated side 62 and lug 72. A notch 76 is provided in the leading edge of arcuate or curved plate 60 so that when venturi valve 56 is in a closed position, a limited amount of air flow may be provided through valve 56 for the idle system.

A metering rod is indicated generally at 78 and has an opening therethrough receiving a pin 80 which is mounted within openings 74 of lugs 72 to support metering rod 78 for pivotal movement relative to air valve 56. Pin 80 may be secured by having a suitable washer press fitted on the end thereof thereby to hold pin 80 within openings 74. Metering rod 78 has a plurality of different sized metering portions 82 on its extending end which project into orifice 52 of orifice plate 50. An annular groove 86 is provided in metering rod 78 adjacent its inner end.

To urge metering rod 78 upwardly against the upper side of orifice 52 as shown in FIG. 5 and forming the present invention is a torsion spring generally indicated at 88. Torison spring 88 comprises a pair of arms 90 and 92, which terminate adjacent one end in a semi-circular collar 94 which fits in annular groove 86. Arm 90 has a large diameter coil 96 thereon with a laterally extending tang 98. Arm 92 has a small diameter coil 100 thereon with a laterally extending tang 102. Pin 80 extends through coils 96 and 100. Tang 98 is in contact with a subjacent lug 72 to continuously urge collar 94 downwardly thereby to urge the outer extending end of metering rod 78 upwardly into engagement with the upper surface defining orifice 52. Tang 102 for small coil 100 extends over the adjacent lug 72 but is spaced from lug 72 in the closed position of air valve 56 as shown in FIG. 1. Tang 102 engages subjacent lug 72 after air valve 56 is around one half open. As shown in FIG. 2, metering rod 78 extends in a generally horizontally direction and there is a substantial horizontal movement of rod 78 from the closed position of venturi valve 56 as shown in FIG. 1 to the open position of venturi valve 56 as shown in FIG. 2. The length of the lever arm for metering rod 78 measured between the pivotal mounting thereof at pin 80 and orifice plate 50 is indicated at L1 in FIG. 2 for the closed position of metering rod 78 while the length of the metering arm for the fully open position is indicated at L2. The lever arm for the intermediate position at which position small coil 100 engages metering rod 78 by contact of tang 102 with lug 72 is shown by L3. Thus, it is apparent that in order for a constant or generally uniform force to be exerted by metering rod 78 against orifice plate 50, a constantly increasing force must be exerting against metering rod 78 to compensate for the increased lever arm resulting from movement of air valve 56. In addition, as air valve 56 moves from closed position to open position, the air flow downwardly in air and fuel mixture conduit 16 tends to urge metering rod 78 downwardly away from the upperside of orifice 52 to counteract the force exerted by torsion spring 88 against metering rod 78.

A light uniform spring force is desired at all positions of metering rod 78 to minimize wear on orifice plate 50 resulting from frictional contact between rod 78 and orifice plate 50. It is also desirable to have metering rod 78 contact the upper side of orifice 52 as the downward air flow in conduit 16 creates a negative pressure on the underside of rod 78 and fuel is removed from the underside of rod 78 at an increased rate.

In operation, and commencing from the closed position of air valve 56 shown in FIG. 1, tang 98 is in engagement with subjacent lug 72 while tang 102 is spaced from subjacent lug 72. Thus, initially, only the large diameter coil 96 is exerting a downward force against metering rod 78. As air valve 56 is moved to a partially open position, metering rod 78 pivots about pin 80 relative to venturi valve 56 to increase the force exerted by large coil 96. After venturi valve 56 travels around one half the distance to full open position shown in FIG. 2 or around (15)°, tang 102 of small diameter coil 100 engages lug 72 and the force of small coil 100 is then exerted against metering rod 78. Upon movement of metering valve 56 to the wide open position of around (30)° of travel air valve 56, both large coil 96 and small coil 100 progressively increase the force exerted against metering rod 78 and this increased force compensates for the increasing lever arm of rod 78 and the downward air flow impinging on the metering rod.

The spring rate of small coil 100 is larger than the spring rate of large coil 96. As shown in the drawings, coil 96 is approximately three times the diameter of coil 100 which has been found to function satisfactorily. It is believed for best results that the diameter of large coil 96 should be at least twice as great as the diameter of small coil 100 in order for metering rod 78 to exert a uniform force against orifice plate 50. The specific spring rates and diameters of coils 96 and 100 would depend on various factors, such as, for example, the size of air valve 56, the length of metering rod 78, the diameter of air and fuel mixture conduit 16, and the specific materials from which orifice plate 50 and metering rod 78 are formed. Orifice plate 50 is subject to wear from constant friction exerted by metering rod 78. Thus, torsion spring 88 provides a minimal frictional contact between metering rod 78 and orifice plate 50 for all positions of rod 78.

What is claimed is:

1. In a carburetor having an air and fuel mixture conduit, a throttle valve within the conduit, an air valve mounted across the conduit above the throttle valve and pivoted adjacent its lower end for movement between open and closed positions relative to the mixture conduit, a metering rod carried by the air valve and extending generally in a horizontal direction, an orifice plate in an opening in the wall of the mixture conduit having a metering orifice therein receiving the extending end of the metering rod, and means on the air valve mounting the metering rod for limited pivoted movement;

the improvement comprising a torsion spring engaging the metering rod to urge the metering rod into contact with the side of the orifice, said torsion spring including two portions thereof which have different spring rates, one portion continuously urging the metering rod against the side of the orifice and the other portion urging the metering rod against the side of the orifice after the air valve has been at least partially opened.

2. In a carburetor as set forth in claim 1 wherein said portions of said torsion spring comprises a large diameter coil portion continuously exerting a torsion force against the metering rod and a small diameter coil portion exerting a torsion force against the metering rod only after the air valve has been partially opened, said large diameter coil portion providing a torsion force against the metering rod which increases constantly upon movement of the air valve from a closed position to an open position.

3. In a carburetor as set forth in claim 1 wherein said air valve comprises a pair of spaced generally vertically extending sides and a web connecting the sides having a central slot therein, pivot means mounting said metering rod within said central slot for limited pivotal movement about a generally horizontal axis relative to the air valve, said portions of said torsion spring comprising a pair of spaced coiled portions on opposite sides of the metering rod, said coiled portions being of different diameters to exert different spring forces against the metering rod to urge the metering rod against the side of the orifice.

4. In a carburetor as set forth in claim 3 wherein said sides each has an inwardly extending lug thereon, said lugs being in opposed spaced relation to each other and said pivot means being supported on said lugs with said metering rod mounted between said lugs for pivotal movement.

5. In a carburetor having an air and fuel mixture conduit, a throttle valve within the conduit, an air valve mounted across the conduit above the throttle valve and pivoted adjacent its lower end for movement between open and closed positions relative to the mixture conduit, a metering rod carried by the air valve and extending generally in a horizontal direction, and an orifice plate in an opening in the wall of the mixture conduit having a metering orifice therein receiving the extending end of the metering rod;

the improvement comprising, spring means engaging the metering rod to urge the metering rod into contact with the side of the orifice, said spring means including two coiled portions thereof which have different spring rates, one coiled portion continuously urging the metering rod upwardly against the upper side of the orifice and the other coiled portion urging the metering rod upwardly against the side of the orifice after the air valve has been at least partially opened, both of said coiled portions exerting a force against the metering rod which after engagement with the metering rod increases constantly upon movement of the metering rod away from the orifice, and pivot means on the air valve mounting the metering rod for pivotal movement about a generally horizontal axis relative to the air valve.

6. In a carburetor as set forth in claim 5 wherein said air valve has a pair of spaced generally vertically extending sides, each side having an inwardly extending lug thereon, said lugs being in opposed spaced relation to each other, said pivot means being in opposed spaced relation to each other, said pivot means being supported on said lugs with said metering rod and said spring means being mounted between said lugs.

7. In a carburetor as set forth in claim 6 wherein said each of the coiled portions of the spring means is mounted adjacent an associated lug and each has a tang thereon fitting over a subjacent lug and contacting the associated lug for increasing the force exerted by the associated coiled portion exerted against the metering rod upon movement of the air valve toward an open position.

* * * * *